US011877611B2

(12) United States Patent
Jacque

(10) Patent No.: US 11,877,611 B2
(45) Date of Patent: Jan. 23, 2024

(54) ADJUSTABLE MIRRORED GLOVE

(71) Applicant: Jeffrey Jacque, Brooklyn, NY (US)

(72) Inventor: Jeffrey Jacque, Brooklyn, NY (US)

( * ) Notice: Subject to any disclaimer, the term of this patent is extended or adjusted under 35 U.S.C. 154(b) by 257 days.

(21) Appl. No.: 15/676,124

(22) Filed: Aug. 14, 2017

(65) Prior Publication Data

US 2017/0340034 A1 Nov. 30, 2017

Related U.S. Application Data

(63) Continuation of application No. 14/715,138, filed on May 18, 2015, now Pat. No. 9,737,101, which is a continuation of application No. 13/093,758, filed on Apr. 25, 2011, now Pat. No. 9,032,552.

(60) Provisional application No. 61/327,233, filed on Apr. 23, 2010.

(51) Int. Cl.
*A41D 19/00* (2006.01)
*A41D 19/015* (2006.01)

(52) U.S. Cl.
CPC ..... *A41D 19/0024* (2013.01); *A41D 19/0017* (2013.01); *A41D 19/0157* (2013.01); *A41D 2600/104* (2013.01)

(58) Field of Classification Search
CPC ..... A41D 19/0017; A41D 19/0024; A41D 19/0157; F21V 33/00; F21V 33/08; F21V 33/21; F21V 33/0076
USPC ..... 2/160
See application file for complete search history.

(56) References Cited

U.S. PATENT DOCUMENTS

| | | | | |
|---|---|---|---|---|
| 1,612,055 | A | 12/1926 | Rannel | |
| 2,113,934 | A | 4/1938 | Denkert | |
| 3,638,011 | A * | 1/1972 | Bain | A41D 19/0157 473/202 |
| 3,717,403 | A | 2/1973 | Messier | |
| 4,054,375 | A | 10/1977 | Ribeca | |
| 4,490,012 | A | 12/1984 | Magiske | |
| 4,863,239 | A * | 9/1989 | Malone | A41D 19/01594 359/879 |
| 5,003,637 | A | 4/1991 | Lonon | |
| 5,257,470 | A | 11/1993 | Auger et al. | |
| 5,309,573 | A | 5/1994 | Solar et al. | |
| 5,361,169 | A | 11/1994 | Deal | |
| 5,373,584 | A | 12/1994 | Parcells, III | |
| 5,530,588 | A | 6/1996 | Vivier | |
| 5,609,529 | A | 3/1997 | Brown | |
| 5,694,261 | A | 12/1997 | Deal | |
| D414,151 | S | 9/1999 | Paquette, Jr. | |
| 6,006,357 | A * | 12/1999 | Mead | G08B 5/006 2/160 |

(Continued)

FOREIGN PATENT DOCUMENTS

| | | | |
|---|---|---|---|
| DE | 19949392 | 4/2001 | |
| GB | 2310788 | * 10/1997 | A41D 19/00 |

(Continued)

OTHER PUBLICATIONS

DE19949392 published Apr. 1, 20019, Abstract only in English, downloaded from espacenet, 1 page.

*Primary Examiner* — Katherine M Moran
(74) *Attorney, Agent, or Firm* — Dentons US LLP

(57) ABSTRACT

Provided is a glove comprising an outer shell comprising a back portion; and a mirror secured to the back portion at one or more points, where the mirror can be adjusted to a plurality of positions on the back portion.

7 Claims, 8 Drawing Sheets

(56) References Cited

U.S. PATENT DOCUMENTS

| | | | | |
|---|---|---|---|---|
| 6,120,157 | A | 9/2000 | Westover | |
| 7,062,792 | B2 | 6/2006 | Jaunault et al. | |
| 7,063,427 | B1 | 6/2006 | Cutler | |
| 7,520,629 | B2 | 4/2009 | Johnson et al. | |
| 8,038,310 | B1 * | 10/2011 | Hale | A41D 19/0157 362/103 |
| 8,291,516 | B2 * | 10/2012 | Chen | A41D 19/0157 2/160 |
| 9,013,100 | B2 * | 4/2015 | Bushee | F21L 4/00 313/512 |
| 9,032,552 | B2 | 5/2015 | Jacque | |
| 2003/0011469 | A1 * | 1/2003 | Bush | A41D 19/0157 340/326 |
| 2004/0255361 | A1 * | 12/2004 | Senter | A41D 19/0157 2/160 |
| 2005/0034212 | A1 * | 2/2005 | Eisenbraun | A41D 19/0027 2/159 |
| 2008/0259477 | A1 | 10/2008 | Gorton et al. | |
| 2009/0034102 | A1 | 2/2009 | Bartlett | |
| 2009/0168407 | A1 * | 7/2009 | Wright | F21V 21/0965 362/103 |
| 2011/0113527 | A1 | 5/2011 | Chen | |
| 2011/0225703 | A1 | 9/2011 | Maple et al. | |
| 2012/0069552 | A1 * | 3/2012 | Richter | A41D 19/0157 362/103 |
| 2012/0081884 | A1 * | 4/2012 | Gonzalez | F21L 4/00 362/103 |
| 2014/0226225 | A1 * | 8/2014 | Suess | G02B 7/002 359/879 |
| 2015/0016093 | A1 * | 1/2015 | Wilson | F21V 33/0008 362/103 |

FOREIGN PATENT DOCUMENTS

| | | | |
|---|---|---|---|
| GB | 2343361 | * 10/2000 | A41D 19/00 |
| WO | WO86/01697 | 3/1986 | |
| WO | WO01/26756 | 4/2001 | |

* cited by examiner

ADJUSTABLE MIRRORED GLOVE

CROSS-REFERENCE TO RELATED APPLICATIONS

This application is a Continuation of U.S. patent application Ser. No. 14/715,138 filed 18 May 2015; which is a Continuation of U.S. patent application Ser. No. 13/093,758 filed 25 Apr. 2011, now U.S. Pat. No. 9,032,552 issued 19 May 2015; which claims a benefit of U.S. Provisional Patent Application Ser. No. 61/327,233 filed 23 Apr. 2010; each of which is incorporated herein by reference in its entirety for all purposes.

BACKGROUND

The present application generally relates to hand held rear view devices. More specifically, a glove having a mirror is provided, where the placement of the mirror is adjustable.

A mirrored glove is useful for several activities where viewing to the rear without turning is desirable. Such activities include bicycling, motorcycling, roller skating including inline skating, snowboarding, snowmobiling, skiing, and ice skating. Several mirrored gloves are available, including those described in German Patent Publication No. DE 199 49 392 A1, U.S. Pat. Nos. 3,717,403; 4,863,239; and 5,003,637; and U.S. Patent Application Publications 2005/0034212 A1; 2008/0259477 A1; and 2009/0034102 A1. However, the mirrored gloves that are available have limited adjustability and/or can be cumbersome in use.

There is thus a need for a simple mirrored glove that can be adjusted to multiple positions. The present invention addresses that need.

SUMMARY

Provided is a glove comprising an outer shell comprising a back portion; and a mirror secured to the back portion at one or more points, where the mirror can be adjusted to a plurality of positions on the back portion.

DETAILED DESCRIPTION

As used herein, the singular forms "a", "an" and "the" are intended to include the plural forms as well, unless the context clearly indicates otherwise. Additionally, the use of "or" is intended to include "and/or", unless the context clearly indicates otherwise.

Provided is a mirrored glove where the mirror can be adjusted to numerous positions. The glove comprises an outer shell comprising a back portion and a mirror secured to the back portion at one or more points. The mirror of the glove can be adjusted to a plurality of positions on the back portion.

In some embodiments, the mirror is permanently secured to the back of the glove. In other embodiments, the mirror can be removed from the glove. The latter embodiments are useful, e.g., when the gloves are used for purposes other than where the mirror is desired, or when the user would like to use different types of mirrors for different purposes, for example when a convex mirror is desired for bicycling but a flat mirror is desired for skiing. A removable mirror is also desirable where the user would like to use a mirror on more than one glove, for example another style of glove, or a paired glove (i.e., left vs. right glove).

Figure 1A:
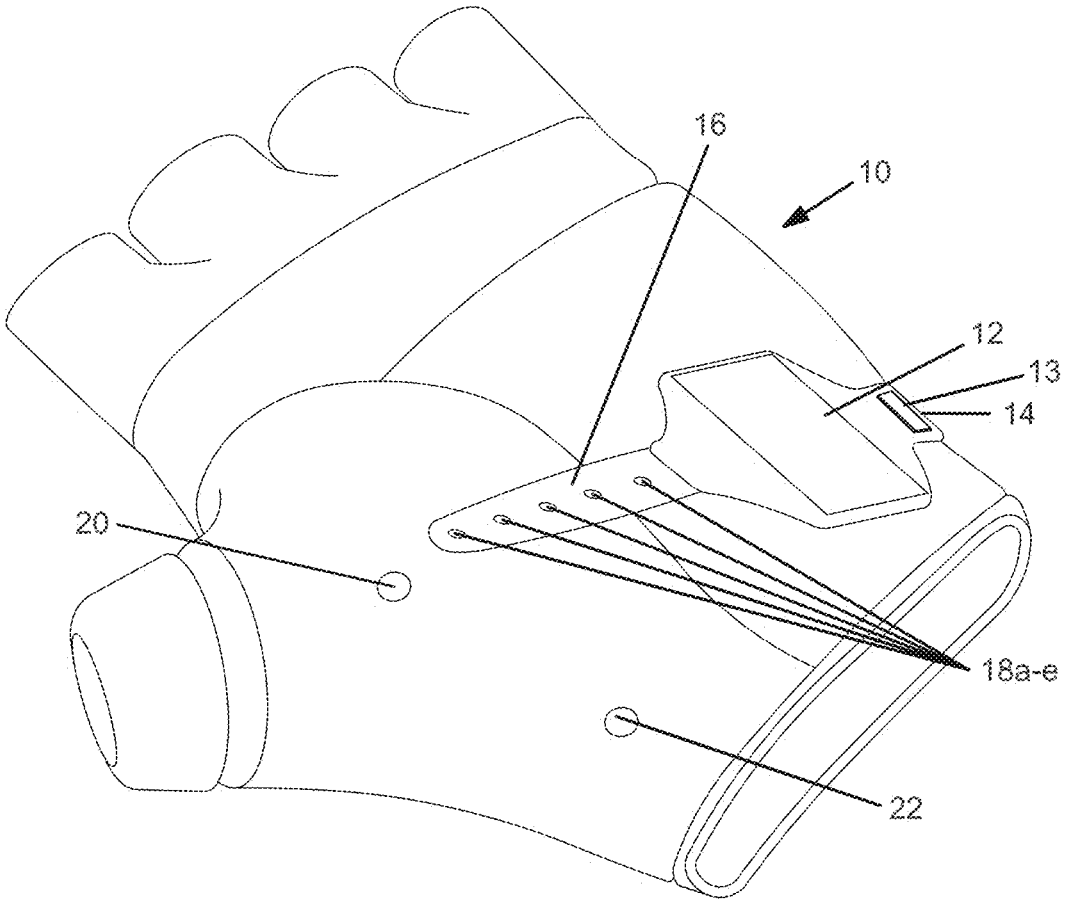
FIGS. 1A-1B are a top view (FIG. 1A) and side view (FIG. 1B) of an embodiment of the invention.
Figure 1B:
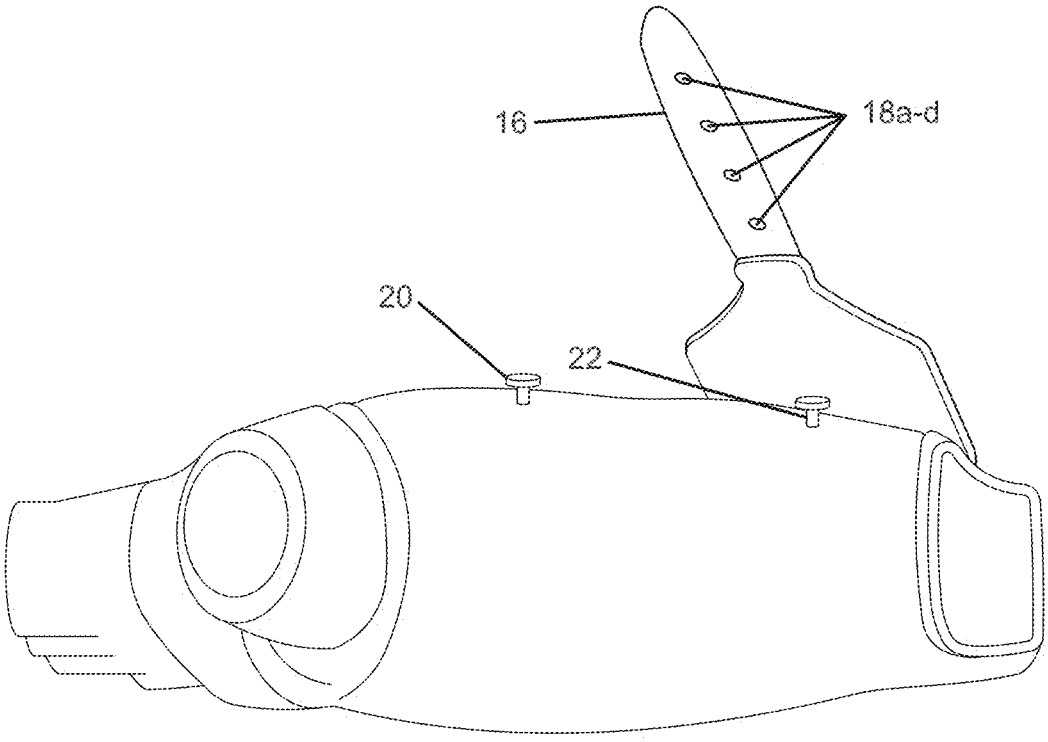
Figure 2A:
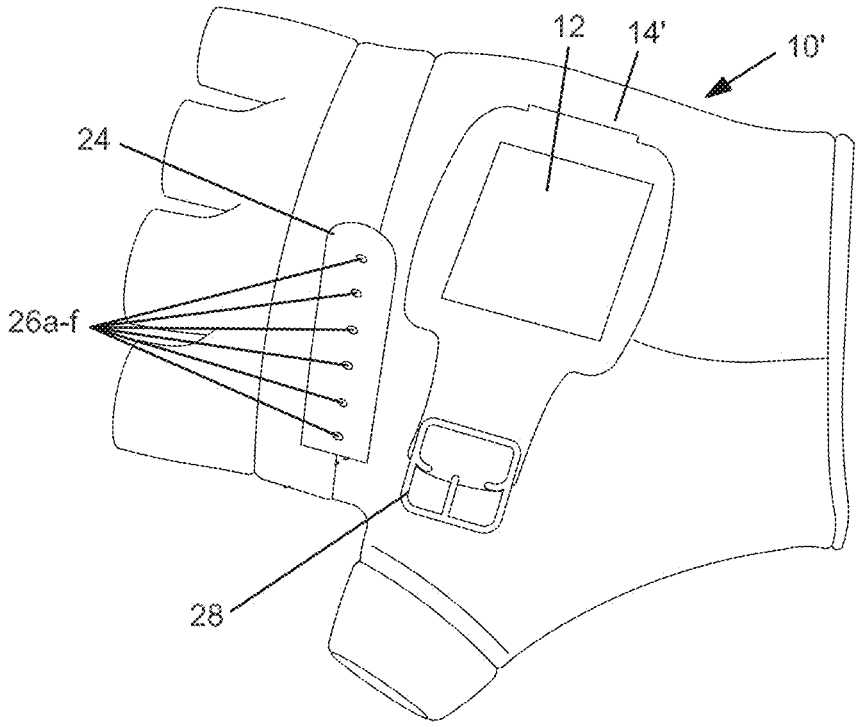
FIGS. 2A-2B are a top view (FIG. 2A) and side view (FIG. 2B) of an embodiment of the invention.
Figure 2B:
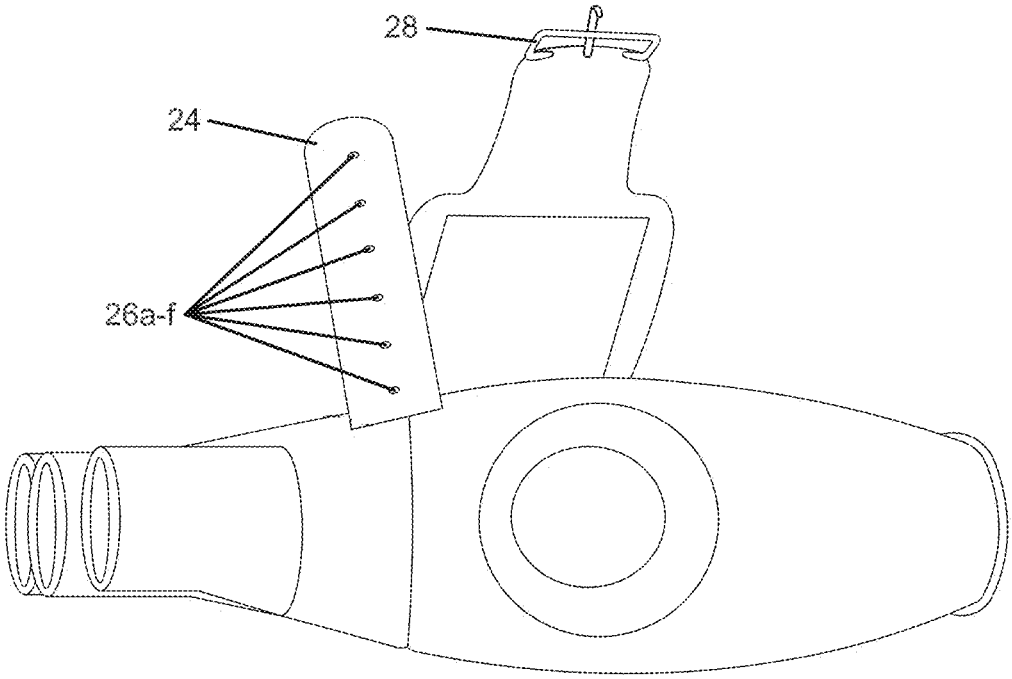

In various embodiments, the mirror is secured to the back portion at a first point and a second point. FIGS. 1 and 2 provide examples of gloves secured at two points. FIG. 1 illustrates a glove 10 with a mirror 12 attached at a first point 14. In these illustrated embodiments, the first point 14 is at a position peripheral to the mirror on the glove. However, in alternative embodiments, the first point is medial to, or above or below, the mirror. The mirror can be attached to the glove at the first point by any means known in the art, for example using Velcro, any buckle (for example a cam buckle, a friction buckle or a side release buckle), a snap, a clip, a spring, a zipper, or a magnet.

In various embodiments, the first point comprises a first adjustment means. The first adjustment means can adjust the mirror in any direction, for example in the forward-rear direction, or, as in the embodiment illustrated in FIG. 1, in the medial-peripheral direction. These embodiments are not narrowly limited to any particular first adjustment means. Examples of such first adjustment means are (a) utilizing Velcro on the mirror portion and the glove portion of the first point and adjusting where the first point 14 is placed on the Velcro; (b) utilizing a tab on the glove and a series of holes on a strap (similar to the second point [20,22] in FIG. 1); and (c) having a series of snaps aligned in the medial—peripheral direction to adjust where the mirror attaches to the glove at the first point. In some embodiments, the first adjustment means comprises a first strap 13 coupled to the mirror and a first attachment means (e.g., a friction buckle) coupled to the glove. The strap 13 comprises a first end portion and a second end portion. The strap 13 extends from the back portion via the first end portion. In these embodiments, the first attachment means is continuously adjustable, such that the first strap 13 can be secured to the first point at a continuous series of positions along the strap allowing adjustment of the mirror in the medial-peripheral direction.

The second point of mirror attachment can utilize any means to attach the mirror known in the art, for example using Velcro, any buckle (e.g., a cam buckle, a friction buckle or a side release buckle), a snap, a clip, a spring, a zipper, or a magnet. In some embodiments, the second point comprises a second adjustment means. The second adjustment means can be designed to adjust the mirror in any direction, for example in the medial-peripheral direction, or, as in the embodiment illustrated in FIG. 1, in the forward-rear direction. In that embodiment, the second adjustment means comprises a second strap 16 coupled to a peripheral edge of the mirror and directed peripherally, the second strap comprising a plurality of holes 18*a-e* deposed axially along the strap; and a plurality of pegs (here, two—20, 22) deposed in a forward-rear direction on the glove. In these embodiments, each of the plurality of holes 18*a-e* along the second strap 16 fits into each of the pegs 20, 22 to form the second point.

FIG. 2 provides an alternative embodiment of the glove described herein. The glove 10' illustrated in FIG. 2 comprises a mirror 12 attached at a first point 14' peripheral to the mirror. The first point 14 comprises a first adjustment means that can be used to adjust the mirror in the medial-peripheral direction. The first adjustment means comprises a first strap coupled to the mirror and a first attachment means (e.g., a friction buckle) coupled to the glove. The first attachment means is continuously adjustable, such that the first strap can be secured to the first point at a continuous series of positions along the strap allowing adjustment of the mirror in the medial-peripheral direction. The first strap 13 comprises a first end portion and a second end portion.

The second point of mirror attachment for the glove 10' illustrated in FIG. 2 comprises a second strap 24 with a plurality of holes 26*a-f* along the second strap, and a buckle 28 that couples with the strap. Optionally, the glove comprises more than one second strap deposed in a forward or rear direction relative to the second strap to provide a second adjustment means along that direction. The second strap 24 comprises a third end portion and a fourth end portion.

Thus, the glove 10' illustrated in FIG. 2 can be adjusted in the medial-peripheral direction by adjusting the first attachment means to move the mirror 12 to the desired location, then buckling the buckle 28 with the strap 24 at the appropriate hole 26*a-f* that allows a secure creation of the second point. The second end portion comprises the buckle 28.

In other embodiments, the mirror is secured to the back portion of the glove at one point. In some of these embodiments, the one point comprises a rigid bendable material, for example a metal, e.g., a wire or a mesh screen. The rigid bendable material is optionally covered with, e.g., a soft, flexible material, for example plastic, rubber, foam or leather.

Figure 6:
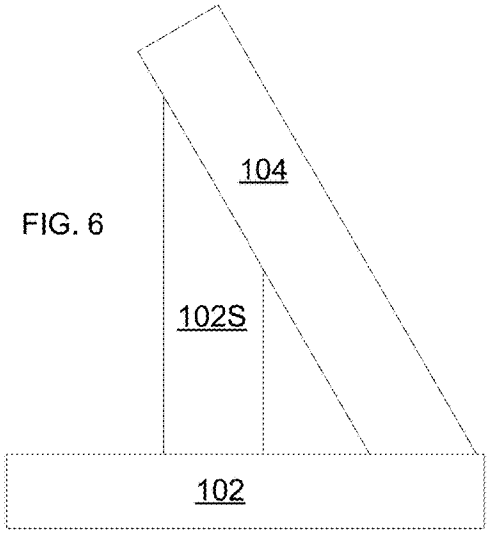
FIG. 6 and FIG. 8 depict a base unit or a strap with a support.
Figure 8:
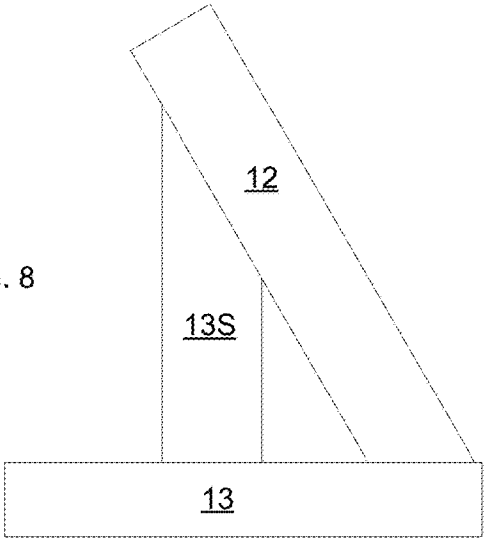

In various embodiments, the glove having the mirror secured to the glove at one point further comprises a means for elevating one side of the mirror (i.e., the side of the mirror opposite the point where the mirror is secured). In some embodiments, as shown in FIG. 6 and FIG. 8, this means for elevating one side of the mirror comprises a support 102S or 13S on a hinge that lies flat under the mirror when the one side of the mirror is not elevated. As used herein, a hinge includes both a hinge structure and an area of a mirror support (e.g., a strap) that bends without a hinge structure. In embodiments where one side of the mirror is elevated, the mirror is elevated by (1) raising the side of the mirror opposite the point where the mirror is secured, exposing the support 102S or 13S, then (2) raising the support 102S or 13S on the hinge. The support 102S and 13S keeps the mirror elevated by blocking the mirror from moving downward.

Figure 7:
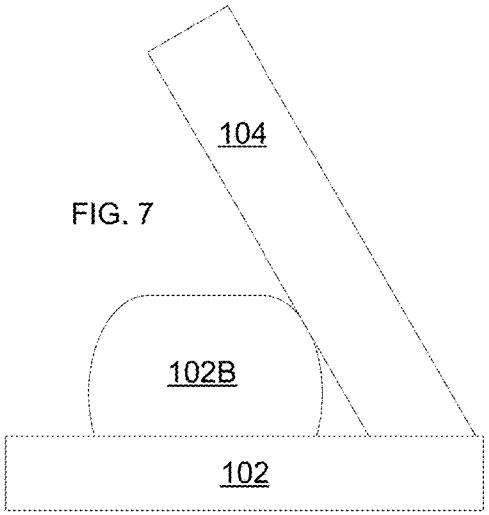
FIG. 7 and FIG. 9 depict a base unit or a strap with an inflatable bladder.
Figure 9:
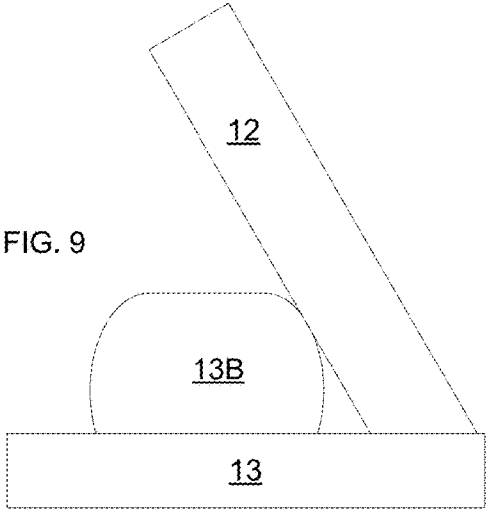

In other embodiments, as shown in FIG. 7 and FIG. 9, the means for elevating one side of the mirror comprises an inflatable air bladder 102B or 13B under the one side of the mirror. In these embodiments, inflating the inflatable air bladder 102B or 13B creates a protrusion under the mirror, elevating the side of the mirror that is not secured. The air bladder 102B or 13B can be inflated by any means known in the art. In some embodiments, the air bladder is inflated with a pump, e.g., as described in U.S. Pat. No. 5,257,470.

The mirrors on the gloves described herein are not narrowly limited to any particular shape, size or composition and includes any surface that is reflective enough to provide a reflected view. In some embodiments, the mirror is flat. In other embodiments, the mirror is convex. In additional embodiments, the mirror is flat in some areas and convex in other areas. The mirror can be made from any material, e.g., glass, metal, or chromed plastic (including plexiglass). In other embodiments, the mirror is encased in a supporting structure, for example a rubber or plastic casing.

The glove to which the mirror is secured can be of any size or shape. For example, the mirror can be for the left hand, for the right hand, or it can be ambidextrous. The glove can also be a mitten. In some embodiments, the glove comprises fingers, e.g., full fingers, or short fingers terminating at an opening. In other embodiments, the glove is fingerless.

Figure 3A:
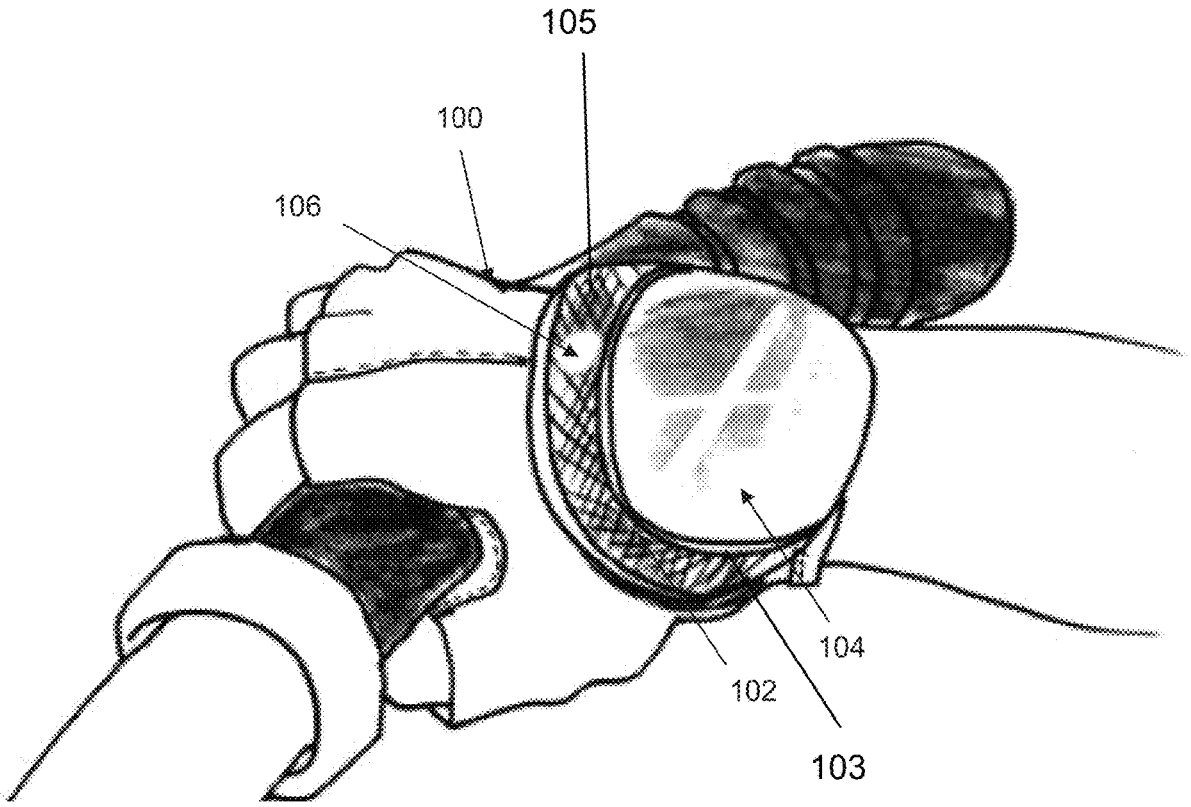
FIGS. 3A-3C depict one embodiment of the invention including a base unit and a mirror.

FIG. 3A depicts another embodiment of the glove including an illumination unit positioned on the glove. Consistent with this embodiment, glove 100 includes a base unit 102 adhered to the glove 100 and a mirror 104 adhered to the top surface of the base unit 102. The base unit 102 comprises a top portion 103 and a side wall 105. The side wall 105 extends between the top portion 103 and the back portion of the glove 100. In one embodiment, the base unit 102 is positioned on the glove at a portion of the glove between the thumb and the index finger. In another embodiment, the base unit 102 is positioned on the top of the glove between the first and fifth finger of the glove unit 100. In yet another embodiment, the base unit 102 is positioned on a side of the glove unit 100 between the middle finger and small finger of the glove unit 100. In one embodiment, the base unit 102 is made from rigid material such as, but not limited to plastic. In another embodiment, the base unit 102 is made from a flexible material such as, but not limited to rubber. In yet another embodiment, the base unit 102 is made from foam.

In one embodiment, the base unit 102 is wedge shaped such that the portion of the base unit 102 closest to the fingers of the glove raises to a point higher than the portion of the base unit 102 located farthest from the fingers. In another embodiment, the mirror 104 is a concave mirror. In yet another embodiment, the mirror 104 is a convex mirror. In one embodiment, the mirror 104 is substantially oval in shape. In another embodiment, the mirror is substantially round in shape. In another embodiment, the lower portion of the base unit 102 is contoured the shape of a human hand on the portion of the glove 100 where the base unit 102 resides.

In another embodiment, the base unit 102 includes at least one lighting unit 106. The lighting unit 106 generates a light beam allowing a user to see in dark environments. In one embodiment, the lighting unit 106 is a light emitting diode. In another embodiment, the lighting unit 106 is an incandescent light. In another embodiment, the lighting unit 106 is positioned on a portion of the base unit 102 closest to the fingers of the glove. In another embodiment, the lighting unit 106 is positioned on the side wall 105 of the base unit 102. The side, comprising wall 105, is a lateral portion that is transparent, where the light beam is output through the lateral portion. The lighting unit 106 is thereby configured to source a light at least in a direction that is lateral to the wall 105 of the base unit 102. In yet another embodiment, the base unit 102 may include a plurality of lighting units 106 arranged around the perimeter of the mirror 104 such that the mirror is illuminated in dark environment.

In another embodiment, the lighting unit 106 emits a white light used to illuminate a dark environment. In another embodiment, the lighting unit 106 emits a red light. In yet another embodiment, the lighting unit 106 is adjustable to provide either white light or red light. In one embodiment, the lighting unit is a LED device which changes colors based on the voltage supplied to the LED. In another embodiment, the lighting unit 106 includes multiple lights of different colors and a switching device located on the base unit 102 electrically coupled to the lighting unit 106 and a power supply that allows a user to select the color of the light emitted from the lighting unit 106.

Figure 3B:
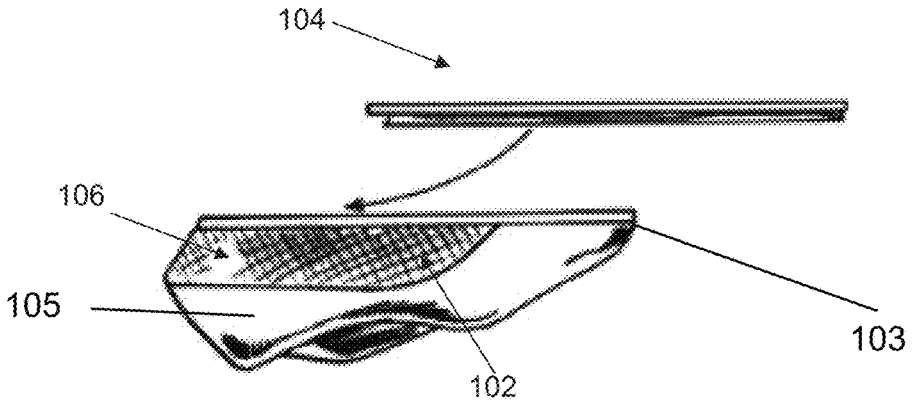

FIG. 3B depicts one embodiment of the mirror 104 attaching to the top of the base unit 102. Consistent with this embodiment, one piece of latch and hook material is adhered to the top surface of the base unit 102 by an adhesive and a corresponding piece of the latch and hook material is adhered to the bottom, non reflecting, surface of the mirror 104 such that the two portions affixedly attached to one another to hold the mirror unit 104 on the base unit 102. In one embodiment, the latch and hook material covers the entire top surface of the base unit 102 and the lower portion of the mirror 104. In another embodiment, the latch and hook material covers only a portion of the top of the base unit 102 and the lower portion of the mirror 104. In one embodiment, the mirror 104 the latch and hook material is Velcro®. As shown in FIGS. 3A and 3B, the base unit 102, such as a housing, is coupled to the back portion of the glove, where the base unit 102 houses the lighting unit 106, such as a light source.

Figure 3C:
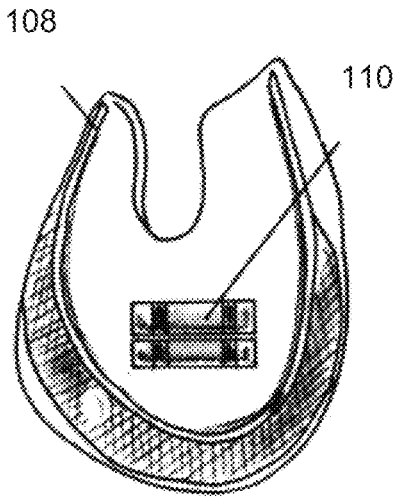

FIG. 3C depicts one embodiment of the top of the base unit 102 including a ridge 108 which engages the sides of the mirror to hold the mirror in place. In one embodiment, the mirror 104 attaches to the base unit 102 using both a ridge and latch and hook material. In one embodiment, the base unit 102 includes a battery unit 110 having an opening in the top of the base unit 102. The battery unit 110 is sized to accommodate at least one battery, with the battery providing power to the lighting unit 106. In one embodiment, the battery unit 110 accommodates three conventional AAA size batteries. In another embodiment, the battery unit 110 accommodates two AA batteries. In yet another embodiment, the battery unit 110 accommodates one nine volt battery.

Figure 4:
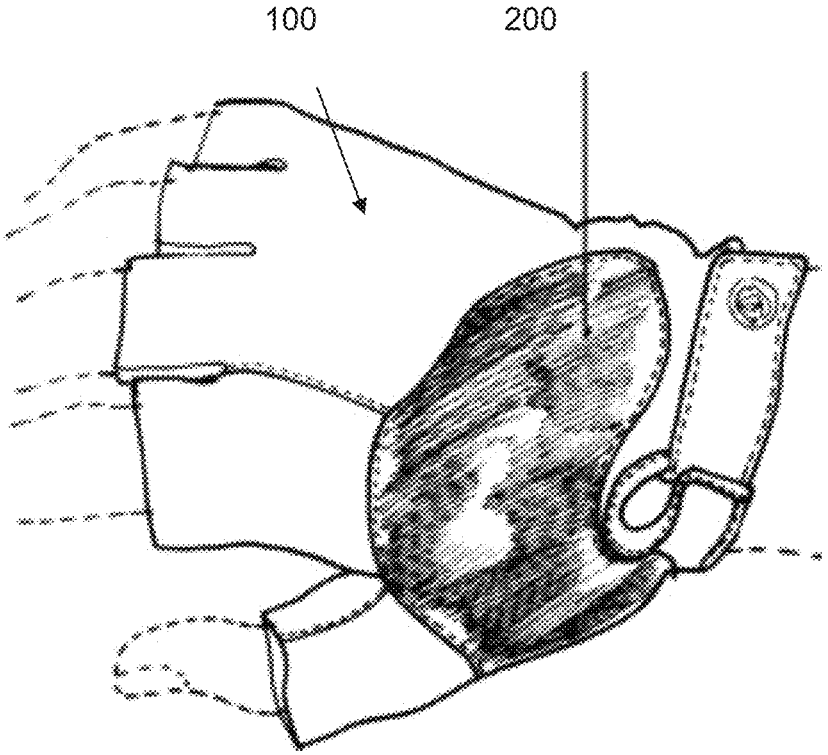
FIG. 4 depicts one embodiment of a glove.
Figure 5:
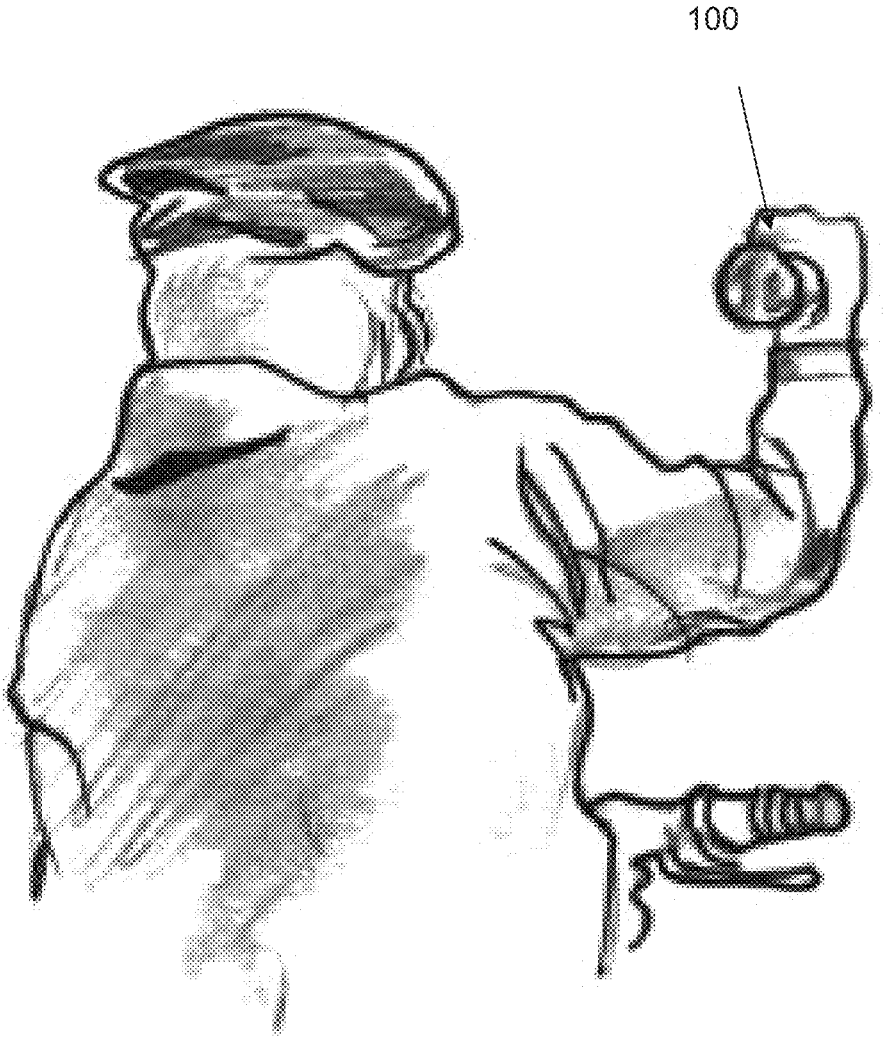
FIG. 5 depicts one embodiment of a user wearing the glove.

FIG. 4 depicts another embodiment of the glove 100. Consistent with this embodiment, the glove 100 includes a latch and hook portion 200 adhered to the surface of the glove. The latch and hook portion 200 is sized to accommodate the bottom surface of the base unit 102 which has a corresponding latch and hook material adhered to the lower surface of the base unit. In another embodiment, the latch and hook portion includes a plurality of snaps which connectively engage with a plurality of snaps positioned on the lower surface of the base unit 102. FIG. 5 depicts one embodiment of a user of the glove 100 utilizing the glove 100 to view objects located behind the user. As shown in FIGS. 1-5, a user can operate a vehicle while wearing a glove including a mirror that presents a rear view and the user can adjust the mirror such that the rear view is changed.

Likewise, as shown in FIGS. 3A-5, a first user can operate a first vehicle while wearing a glove including a light source configured to source a light and the first user can raise the glove such that a second user of a second vehicle can observe the light, where the first vehicle is in front of the second vehicle.

Other embodiments within the scope of the claims herein will be apparent to one skilled in the art from consideration of the specification or practice of the invention as disclosed herein. It is intended that the specification be considered exemplary only, with the scope and spirit of the invention being indicated by the claims.

REFERENCES

German Patent Publication No. DE 199 49 392 A1
PCT Patent Publication WO 86/01697.
U.S. Pat. No. 3,717,403.
U.S. Pat. No. 4,054,375.
U.S. Pat. No. 4,490,012.
U.S. Pat. No. 4,863,239.
U.S. Pat. No. 5,003,637.
U.S. Pat. No. 5,257,470.
U.S. Pat. No. 5,361,169.
U.S. Pat. No. 5,373,584.
U.S. Pat. No. 5,530,588.
U.S. Pat. No. 6,120,157.
U.S. Pat. No. 7,063,427.
U.S. Patent Application Publication No. 2005/0034212 A1.
U.S. Patent Application Publication No. 2008/0259477 A1.
U.S. Patent Application Publication No. 2009/0034102 A1.

In view of the above, it will be seen that the several advantages of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

What is claimed is:

1. A glove, comprising:

an outer shell including a back portion; and a housing directly coupled to the back portion, wherein the housing comprises a side wall, wherein the side wall including a transparent portion, wherein the housing houses a light source, wherein the light source is oriented to source a light at least in a direction that is lateral through the transparent portion of the side wall;

a mirror having a side, wherein the mirror is coupled to the housing; and a structure configured to elevate the side, wherein the structure includes a support on a hinge that lies flat under the mirror when the side of the mirror is not elevated, wherein the back portion is configured to support the structure.

2. The glove of claim 1, wherein the mirror is positionally adjustable with respect to the housing.

3. The glove of claim 1, wherein the mirror is selectively detachable from the housing.

4. The glove of claim 1, wherein the mirror comprises a first section and a second section, wherein the first section is more elevated from the housing than the second section.

5. The glove of claim 1, wherein the mirror is encased in a casing.

6. The glove of claim 1, wherein the housing is selectively detachable from the back portion.

7. The glove of claim 1, wherein the light source includes a plurality of light sources, wherein the housing has a perimeter, wherein the light sources are positioned along the perimeter.

* * * * *